United States Patent [19]

Kehler

[11] Patent Number: 4,787,773

[45] Date of Patent: Nov. 29, 1988

[54] SURFACE DRAINAGE SYSTEM

[76] Inventor: Glen M. Kehler, 846 Oakdale Drive, Winnipeg, Manitoba, Canada, R3R 1A3

[21] Appl. No.: 55,190

[22] Filed: May 28, 1987

[30] Foreign Application Priority Data

Jun. 4, 1986 [CA] Canada ..... 510787

[51] Int. Cl.[4] ..... E02B 5/00; E01C 11/22

[52] U.S. Cl. ..... 405/118; 404/4; 405/36; 405/124

[58] Field of Search ..... 405/36, 43, 118, 119, 405/121, 124, 126; 404/2, 4

[56] References Cited

U.S. PATENT DOCUMENTS

| | | | |
|---|---|---|---|
| 1,362,952 | 12/1920 | McQueary | 405/118 X |
| 2,436,593 | 2/1948 | Moselowitz | 404/4 |
| 3,212,267 | 10/1965 | Biehn | 404/2 X |
| 3,225,545 | 12/1965 | Flegel | 405/43 |
| 3,465,654 | 9/1969 | Fox | 404/4 |
| 3,625,011 | 12/1971 | Stevenson . | |
| 3,714,786 | 2/1973 | Evans et al. . | |
| 4,663,894 | 5/1987 | Laroche et al. | 405/118 X |

FOREIGN PATENT DOCUMENTS 1138217 12/1982 Canada .

*Primary Examiner*—David H. Corbin

*Attorney, Agent, or Firm*—Jacobson and Johnson

[57] ABSTRACT

Floor drainage systems in locations using a relatively large amount of water are usually covered with expanded metal gratings which easily become blocked and do not allow sufficient support for relatively heavy vehicular traffic to pass thereover. The present device utilizes a culvert section having spaced apart upper angle members and a sheetmetal culvert depending there below, the depth of which gradually increases from one end to the other. Location tabs extend from the sides of the culvert along the length thereof and these are all spaced the same distance downwardly from the upper angle members so that the sections are all readily supported upon pegs placed along the trench at the same depth from the surface. Concrete may then be poured around and under the culvert and the floor surface finished flush with the upper surface of the angle members so that only an elongated slot is seen when the installation is completed.

21 Claims, 1 Drawing Sheet

SURFACE DRAINAGE SYSTEM

BACKGROUND OF THE INVENTION

This invention relates to new and useful improvements in drainage system installations, particularly installations made in buildings used for processes requiring a relatively large amount of water which has to be drained away and either disposed of or recirculated.

Such systems may include but are not limited to car washes, abbatoirs, fresh vegetable treatment areas, canneries, and the like.

Conventionally, such drainage systems consist of trenches formed in the floor, and concrete or metal lined during the installation of the floor, with expanded metal gratings covering same. These are not only extremely labour intensive in installation due to the requirement of maintaining the necessary drainage slope to the trenches but also suffer from disadvantages such as breakage particularly when extensive vehicular traffic is present such as forklifts, trucks and the like. Furthermore such gratings often become clogged with debris which is difficult to remove. Such installations are also difficult to clean as the gratings have to be removed so that the trench or trough can be washed or scraped clean.

The present invention overcomes these and other disadvantages by providing a metal lined trough situated below floor level with a relatively narrow slot acting as the water entrance to the trough and one aspect of the invention is to provide a culvert assembly for use in a trench type floor drain system comprising in combination a pair of longitudinally extending upper members in spaced and parallel relationship thereby defining an elongated drainage slot therebetween, a culvert component secured to and depending from said members, said culvert component including a trough-like base portion and side flange portions extending upwardly therefrom, one from each side edge of said trough-like base portion and being secured by the upper edges thereof, one to each of said upper members, depth registration and support anchor members extending outwardly from the sides of said culvert component and spaced along the length thereof, said depth registration and support anchor members all being equidistantly spaced downwardly from said upper members.

Another aspect of the invention is to provide a culvert section for a culvert assembly in a trench type floor drain system, said section comprising in combination a pair of spaced and parallel, longitudinally extending upper, right angled members defining a drain slot therebetween and a culvert component secured to and depending from said members with the slot operatively communicating with the interior of said culvert component, said culvert component including a trough-like base portion and side flange portions extending upwardly from each longitudinal side edge of said base portion, the upper edges of said side flange portions being secured one to each right angled member.

A still further aspect of the invention is to provide a method of forming a culvert assembly for use in a trench type floor drain system which comprises the steps of forming a trench in the floor, placing a plurality of support pegs on each side of the base of the trench at spaced intervals therealong and with the upper ends of the support pegs being substantially the same distance below the floor, laying the culvert assembly in said trench with said culvert assembly including a pair of spaced and parallel upper members defining an elongated slot therebetween and a culvert component extending below said upper members and being secured thereto and including depth registration and support anchor members extending outwardly from the sides of said culvert assembly, said anchor members registering upon the upper ends of said support pegs, securing the anchor members to the upper ends of said support pegs, laying reinforced steel along the ground surface and across said trench and under said culvert assembly pouring concrete in said trench and under said, culvert and upon the floor, finishing the surface of the concrete on said floor sloping downwardly towards and flush with the upper sides of said upper members.

A further advantage of the system is that the sections of the complete length can be prefabricated and can be readily installed by relatively unskilled labour, the positioning thereof depending upon design parameters.

A still further advantage of the invention is to provide a device and method of the character herewithin described which is simple in construction, economically manufactured and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Before proceeding with the description of the invention, it should be noted that although the invention is described as being formed in sections which can be adjacently connected together upon installation, nevertheless it will be appreciated that an entire length can be formed depending upon the overall length required and the design parameters of the installation.

Figure 1:
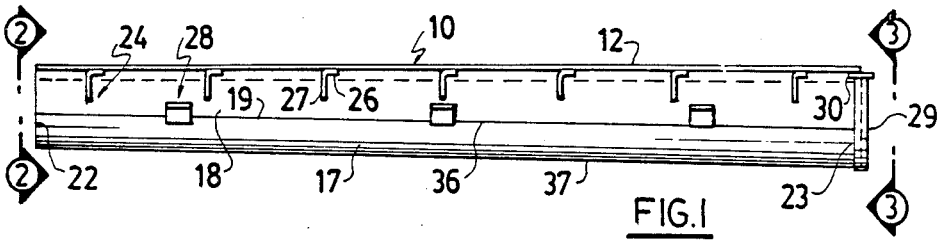
FIG. 1 is a side elevation of a section of the drainage system.

FIG. 1 shows, in side elevation, a section or complete assembly of the invention collectively designated 10. It may be manufactured from galvanized steel or stainless steel once again depending upon design parameters and the use to which the installation is to be placed. For example, in killing floors and abbatoirs, it is necessary that stainless steel be used and that all junctions be welded in order to prevent contamination from occurring but in installations such as car washes and the like for example, the sections may be adjacently registered one with the other and may be of galvanized steel or the like.

Figure 2:
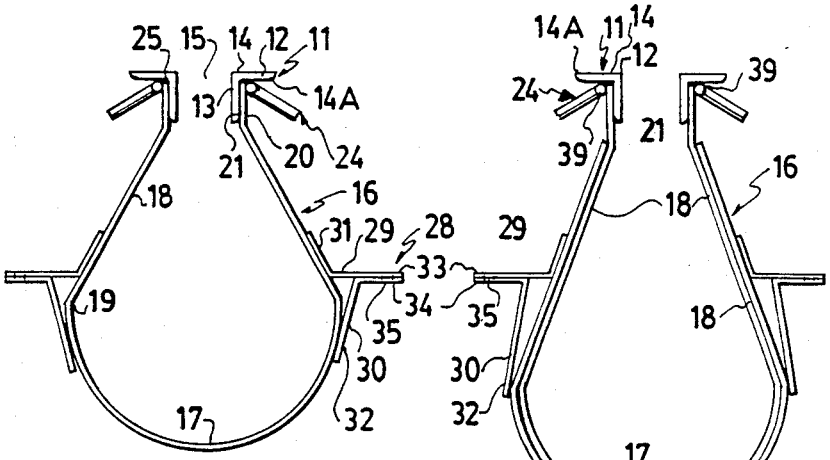
FIG. 2 is an enlarged end view of FIG. 1 along the line 2—2 thereof.
Figure 3:
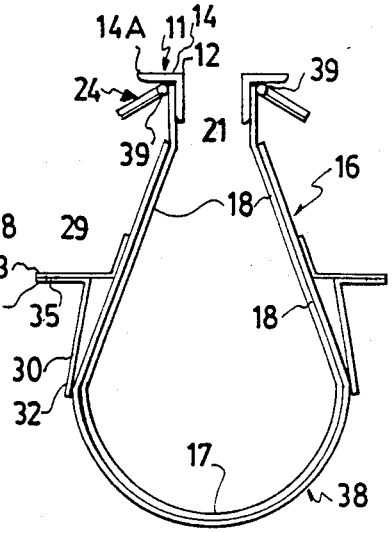
FIG. 3 is an enlarged end view of FIG. 1 along the line 3—3 thereof.

The end views of the section 10 are illustrated in FIGS. 2 and 3 and are similar with the exception of the dimensions as will hereinafter become apparent.

A pair of spaced and parallel longitudinally extending right angled members 11 are situated in spaced and parallel relationship one another with each right angled member including a substantially horizontal flange 12 and a substantially vertical flange 13 extending downwardly from the inner edge 14 of the horizontal members. These vertical members 13 define a drainage slot 15 therebetween which extends the full length of the section 10.

A culvert component collectively designated 16 is secured to and depends from the right angled members 11 and consists of a substantially semi-circular crosssectioned troughlike base portion 17 with side flange portions 18 extending upwardly and inwardly from the upper edges 19 of the base portion 17. The upper ends of the side flange portions are angulated vertically to form attachment flanges 20 and these are welded to the outer surfaces 21 of the vertical flanges 13 of the members 11.

The cross-sectional configuration and dimensions of the trough-like base portion 17 remain consistent from one end of the assembly to the other or from one end of the section 10 to the other but the depth of the side flange portions 18 increases gradually from one end indicated by reference character 22 towards the other end indicated by reference character 23 and although the increase of depth depends upon design parameters, nevertheless, in a ten foot length section, the slope of the trough-like base portion should, as an example, increase approximately ⅛th of an inch per foot thus giving adequate drainage characteristics to the installation if the upper members 11 are laid substantially horizontally along and below the floor surface.

Pairs of upper anchors collectively designated 24 are situated adjacent the underside junction 25 of the flanges 12 and 13 of the members 11 and one embodiment shows cylindrical cross-section members angulated at the upper end thereof as at 26 and welded to adjacent the angle 25 with the major leg 27 extending outwardly and downwardly from the horizontal as clearly shown in FIGS. 2 and 3.

Combination depth registration and support anchor members are provided and collectively designated 28 and these are also situated along each side of the section or assembly and are secured to the outer surfaces of the culvert component 16. These consist of flat strap members and include upper member 29 and a lower member 30. The inner angulated sides 31 and 32 respectively are spot welded or otherwise secured to the outer surfaces of the culvert component and the horizontal legs 33 and 34 respectively are in interfacial relationship and are spot welded or otherwise secured together and extend outwardly parallel to the floor surface. These are apertured as at 35, the purpose of which will hereinafter be described.

Of importance is that the horizontal strap portions 33 and 34 remain the same distance below the upper surface 14A of the right angled members 11 regardless of the location of these horizontal portions along the length of the section or assembly. This is clearly shown in FIGS. 1, 2 and 3 with a dimension line 36 being illustrated on FIG. 1 for explanatory purposes. This line is parallel with the sloping lower side 37 of the trough-like portion 17 and increases in distance below the horizontal flanges 12 of the members 11 from end 22 towards end 23.

When the system is provided in sections, it will of course be appreciated that each subsequent section has an end 22 corresponding in configuration to the end 23 of the subsequent section and the ends 23 of the sections are provided with means to register one section relative to the other when installed.

This takes the form of a surrounding alignment band collectively designated 38 which is secured to the culvert component 16 and extends from adjacent the junction between the vertical portions 20 and portions 18 of the side flanges of the component, on one side, and then around the outside of the trough-like base portion and upwardly on the outside of the opposite side flange portion 18 as clearly shown in FIGS. 1 and 2. It may be spot welded in position and FIG. 1 will show that the outer edge 29 extends beyond the end 23 of the section.

Relatively short dowels 30 are secured to and extend beyond the end 23, said dowels being secured within the angle 25 similar to the portions 26 of the upper anchors 24.

When two adjacent sections are registered together, the end 22 of the following section nests within the extending portion 29 of the alignment band 28 and the corresponding inner angle 25 of the right angled members 11 rest on the extending portions of dowels 39. As mentioned previously if required, the two sections may then be welded together to completely seal same or may be registered one with the other with sealant (not illustrated) provided if desired.

Figure 5:
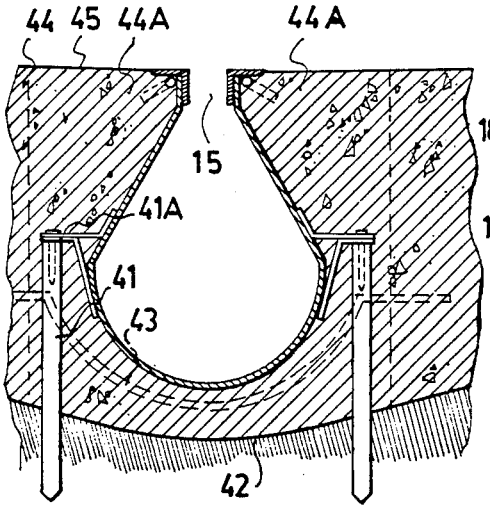
FIG. 5 is a cross sectional end view showing the system installed within the concrete floor.
Figure 4:
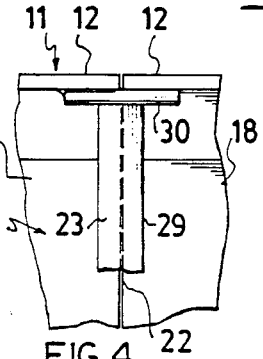
FIG. 4 is an enlarged fragmentary side elevation showing the junction between adjacent sections.

FIG. 5 shows schematically, a method of installation. First, the trench 40 is formed in the surface upon which the floor is to be poured and at the location of the elongated culvert type drain installation. It may terminate in a pit, for recovery of the water, or may be connected to a drainage system in a conventional manner and of course a plurality of such trenches may be provided if drainage is required over the entire floor surfaces. Once again this depends upon design and the size of the installation.

After the trench has been dug, support pegs 41 are engaged within the trench on opposite sides thereof and in locations adjacent to where the combination depth registration and support anchor members 28 will be situated and these pegs are inserted until all of the upper surfaces 41A are exactly the same distance below the location of the finished floor surface. The culvert assembly or culvert sections are then placed in position with the horizontal portions 33/34 of the supports 28 registering upon the upper surfaces of the opposed pairs of pegs.

This ensures that the upper flanges 12 of the members 11 are horizontal and flush with the finished floor surface and also ensures that the requisite slope is provided to the trough-like base portion 17.

Adjacent sections are registered one with the other as hereinbefore described and either sealed or welded once again depending upon the installation.

Reinforcing steel 43 may then be placed spaced above the base of the ground surface and across the trench underneath the culvert sections as required whereupon concrete 44 may be poured into the trench and under the culvert assembly and on the ground surface up to the finished level 45 of the concrete floor of the building.

The concrete is finished flush with the upper surface 14A of the horizontal flanges 12 of the members 11 and adjacent these members it may be sloped downwardly slightly to provide floor drainage to the drainage slots 15.

Due to the resiliency of the side flange portions 18 of the culvert component, the vertical flanges 13 of the right angled members 11 may be positioned, within limits, so that the width of the slot 15 may be controlled. If necessary, during the pouring of the concrete, blocks (not illustrated) may be placed between the vertical flanges 13 to prevent a slot becoming narrower than desired.

The width of the slot depends upon the installation. If, for example, it is used where animals such as pigs are present, then the slot should be narrow enough so that the feet thereof do not become engaged between the flanges 13. If larger animals or no animals will be using the building then the slot can be wider by spacing apart the vertical flanges 13, a greater amount.

In all cases, the vehicular traffic can easily pass thereover and in this connection it should be noted that the concrete areas indicated by reference characters 44A can provide reinforcement for traffic at these locations.

It should also be observed that the right angled members 14A are tilted slightly so that the vertical flanges 13 incline outwardly and downwardly thus providing that the width of slot 15 at the upper side thereof is slightly narrower than the width of the slot at the lower end thereof. This prevents debris from lodging between the flanges 13 as if it will pass through the upper sides of the slot, it will not jam between the flanges, lower down.

Figure 6:
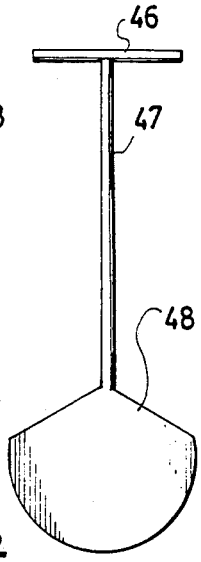
FIG. 6 is an isometric view of one embodiment of a clean out shovel.

Finally reference should be made to FIG. 6 which shows one form of a clean out shovel consisting of a cross handle 46, a vertical handle portion 47 extending from the centre of cross handle 46 and a paddle shaped blade 48 having a configuration similar to the end 22 of the culvert section. This means that it can be turned sideways, inserted in the slot 15 and then turned 90 degrees which will assist in the clean out of any debris at the bottom of the trough-like base portion as it is moved along the culvert.

Under normal circumstances, however, a high pressure hose inserted through slot 15 will be sufficient to clean the interior of the culvert sections.

Features include a continuous unobstructed slot at the top which allows water to drain off the floor continuously and allows all vehicles and foot traffic (human and animal) to cross without damage to the drain or to the vehicle wheels.

The shape of the drain system does not change from one end to the other with the exception of the side flanges which become deeper as the invert of the drain is lowered at the preferred rate of $\frac{1}{8}$th of an inch per foot on a ten foot section of drain. In other words, one end of a ten foot section is always $1\frac{1}{4}$ inches lower than the other end.

The drain is totally cast in reinforced concrete on site so that installation costs are minimal as all of the alignment flanges 33/34 are at the same elevation and welding is, only required under certain circumstances.

Furthermore the width of the slot 15 will not allow any large objects to enter into the sewer systems and plug the drains. The unique shape makes it easy to clean and the simple and unique design allows manufacturing and installation to be done economically.

The floor of the installation is readily kept clean with the minimum of water as the waste and debris can be washed off the floor and into the drainage system. It should also have been noted that the depth of the inlet slot is relatively shallow which assists in preventing blockage from occurring and that relatively little maintenance is required.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A culvert assembly for use in a trench type floor drain system comprising in combination a pair of longitudinally extending upper members in spaced and parallel relationship defining an elongated, unobstructed drainage slot therebetween, a culvert component secured to and depending from said members, said culvert component including a longitudinally extending through-like base portion below the drainage slot and sloping with respect to the upper members from a first end of the assembly to a second end thereof, and side flange portions converging upwardly from respective side edges of said through-like base portion and being secured along upper edges thereof to respective ones of said upper members, depth registration and support snchor members extending outwardly from the sides of said culvert component along the length thereof, said depth registration and support anchor members all being equidistantly spaced downwardly from said upper members.

2. The assembly according to claim 1 in which said upper members are in the form of right angulated members including a horizontally positioned, outwardly extending flange and a substantually vertical flange depending downwardly from the inner edges of said slot between said vertical members.

3. The assembly according to claim 1 in which said culvert assembly includes a plurality of elongated sections engageable with one another in longitudinally extending serial relationship and alignment means adjacent the said upper members of each section registering with the end of the next adjacent section.

4. The assembly according to claim 2 in which said culvert assembly includes a plurality of elongated sections engageable with one another in longitudinally extending serial relationship and alignment means adjacent the said upper members of each section registering with the end of the next adjacent section.

5. The assembly according to claim 3 which includes a band extending around each said section at one end thereof and projecting beyond said one end for engagement around an adjacent end of an adjacent section, said alignment means comprising dowels extending longitudinally from each of said upper members at said one thereof and projecting beyond said one end for engagement under the upper members of the next adjacent section.

6. The assembly according to claim 4 which includes a band extending around each said section for engagement around an adjacent end of an adjacent section, said alignment means comprising at one end thereof and projecting beyond said one end for engagement around an adjacent end of an adjacent section, said alignment means comprising dowels extending longitudinally from each of said upper members at said one end thereof and projecting beyond said one end for engagement under the upper members of the next adjacent section.

7. The assembly according to claim 5 which includes upper anchor members extending outwardly and downwardly from the underside of said upper members and being spaced along the length of said sections.

8. The assembly according to claim 6 which includes upper anchor members extending outwardly and downwardly from the underside of said upper members and being spaced along the length of said sections.

9. The assembly according to claim 1 in which the locations of said upper members are adjustable relative to one another within limits during installation thereby controlling the width of the slot defined therebetween.

10. The assembly according to claim 7 in which the locations of said upper members are adjustable relative to one another within limits during installation thereby controlling the width of the slot defined therebetween.

11. The assembly according to claim 2 in which said vertical flanges incline outwardly and downwardly from one another from the upper ends thereof towards the lower ends thereif to prevent debris lodging therebetween.

12. The assembly according to claim 8 in which said vertical flanges incline outwardly and downwardly from one another from the upper ends thereof towards the lower ends thereof to prevent debris lodging therebetween.

13. A culvert section for a culvert assembly in a trench type floor drain system, said section comprising in combination a pair of spaced and parallel, longitudinally extending upper right angled members defining an unobstructed drain slot therebetween and a culvert component secured to and depending from said members with the slot operatively communicating with the interior of said culvert component, said culvert component including a longitudinally extending trough-like base portion below the slot and sloping from a first end of the section to a second end with respect to the upper members and side flange portions converging upwardly from the respective longitudinal side edges of said base portion, the upper edges of said side flange portions being secured to respective ones of the right angled members.

14. The section according to claim 13 which includes depth registration and support anchor members extending outwardly from each side of said culvert component along the length thereof and being equidistantly spaced downwardly from said upper members.

15. The section according to claim 14 which includes coupling means on the second end of said section cooperating with the first end of an adjacent section to operatively connect said sections together.

16. The section according to claim 15 in which said coupling means includes a band engaged around and extending beyond the second end of said culvert component and dowels extending longitudinally from said second end, one upon each side thereof and adjacent said upper members, the first end of said adjacent section registering on the projecting portion of said band, said upper members of said first end of said adjacent section registering upon the projecting portions of said dowels.

17. The section according to claim 13 in which said right angled members include a horizontal outwardly extending flange and a substantially vertical flange depending from the inner edges of said horizontal flange thereby defining said slot therebetween.

18. The section according to claim 17 in which said vertical flanges incline outwardly and downwardly away from one another from the upper sides thereof towards the lower sides thereof to prevent debris lodging therebetween.

19. The section according to claim 17 in which the location of said upper members are adjustable relative to one another within limits, during installation, thereby controlling the width of the slot defined therebetween.

20. The culvert section according to claim 13 in which the base portion has a substantially semi-circular transverse cross-section of uniform dimensions from end to end.

21. The section according to claim 20 in which the side flanges are substantially straight in transverse cross-sections.

* * * * *